US007686010B2

(12) United States Patent
Gustavsen

(10) Patent No.: US 7,686,010 B2
(45) Date of Patent: Mar. 30, 2010

(54) HIGH TEMPERATURE BAKE OVEN

(76) Inventor: Willard Gustavsen, 12142 Range Line Rd., Berrien Springs, MI (US) 49103

( * ) Notice: Subject to any disclaimer, the term of this patent is extended or adjusted under 35 U.S.C. 154(b) by 1 day.

(21) Appl. No.: 12/044,066

(22) Filed: Mar. 7, 2008

(65) Prior Publication Data

US 2009/0064985 A1 Mar. 12, 2009

Related U.S. Application Data

(60) Provisional application No. 60/993,394, filed on Sep. 12, 2007.

(51) Int. Cl.
*A21B 1/04* (2006.01)

(52) U.S. Cl. ..... 126/273.5; 126/29; 126/25 R; 126/275 R

(58) Field of Classification Search ..... 126/1 R, 126/25 R, 27, 273.5, 274, 275 R, 29, 39 K, 126/39 L, 39 R, 400, 505, 506; 99/447
See application file for complete search history.

(56) References Cited

U.S. PATENT DOCUMENTS 641,575 A * 1/1900 Boud ..... 126/506
898,527 A * 9/1908 Thoits et al. ..... 126/273.5
RE13,110 E * 5/1910 Thoits et al. ..... 126/273.5
1,049,633 A * 1/1913 Whitmer ..... 126/273.5
1,072,231 A * 9/1913 Howell ..... 126/274
1,404,808 A * 1/1922 Taylor ..... 126/9 R
2,019,604 A * 11/1935 Grieve ..... 126/4
2,095,654 A * 10/1937 Thoreson ..... 126/9 R
3,313,917 A * 4/1967 Ditzler et al. ..... 219/400
3,952,721 A * 4/1976 Patterson ..... 126/506
4,455,319 A * 6/1984 Clark ..... 426/233
4,498,376 A * 2/1985 Carey ..... 99/345
4,800,865 A * 1/1989 Setzer ..... 126/21 R
4,889,103 A * 12/1989 Fraioli ..... 126/92 AC
5,039,535 A * 8/1991 Lang et al. ..... 426/233
5,413,033 A * 5/1995 Riccio ..... 99/339
5,532,456 A * 7/1996 Smith et al. ..... 219/400
5,586,488 A * 12/1996 Liu ..... 99/331
5,883,362 A * 3/1999 Pettibone et al. ..... 219/411
5,954,980 A * 9/1999 Westerberg et al. ..... 219/411
6,011,242 A * 1/2000 Westerberg ..... 219/411
6,041,769 A * 3/2000 Llodra et al. ..... 126/41 R
RE36,724 E * 6/2000 Westerberg et al. ..... 219/685
6,070,572 A * 6/2000 Casagrande ..... 126/506
6,125,740 A * 10/2000 Hedrington et al. ..... 99/392
6,187,359 B1 * 2/2001 Zuccarini ..... 426/505
6,262,396 B1 * 7/2001 Witt et al. ..... 219/411
6,354,194 B1 * 3/2002 Hedrington et al. ..... 99/341
6,384,381 B2 * 5/2002 Witt et al. ..... 219/411

(Continued)

*Primary Examiner*—Kenneth B Rinehart
*Assistant Examiner*—Jorge Pereiro
(74) *Attorney, Agent, or Firm*—Howard & Howard Attorneys PLLC

(57) ABSTRACT

A high temperature bake oven including a source of heat, a first stone-like plate located above the heat source receiving an item to be baked, a second stone-like plate located above the first plate and a housing enclosing the first and second plates forming a bake oven chamber between the first and second plates having a front opening directing convection heat upwardly from the heat source against the first and second plates and between the plate over an item to be baked.

19 Claims, 4 Drawing Sheets

U.S. PATENT DOCUMENTS

| | | | | |
|---|---|---|---|---|
| 6,640,695 | B2 * | 11/2003 | Stark | 99/447 |
| 6,967,036 | B1 * | 11/2005 | Hedrington et al. | 426/466 |
| 2002/0017290 | A1 * | 2/2002 | Hines, Jr. | 126/41 R |
| 2002/0060215 | A1 * | 5/2002 | Allera et al. | 219/394 |
| 2002/0069764 | A1 * | 6/2002 | Cohen | 99/331 |
| 2003/0145740 | A1 * | 8/2003 | Stark | 99/447 |
| 2005/0034716 | A1 * | 2/2005 | Harbin | 126/25 R |
| 2005/0039612 | A1 * | 2/2005 | Denny | 99/450 |
| 2006/0102167 | A1 * | 5/2006 | Driscoll, Jr. | 126/275 R |
| 2006/0191528 | A1 * | 8/2006 | Spangrud | 126/275 R |

* cited by examiner

HIGH TEMPERATURE BAKE OVEN

RELATED APPLICATION

This application claims priority to U.S. Provisional Patent Application Ser. No. 60/993,394 filed Sep. 12, 2007.

FIELD OF THE INVENTION

This invention relates to a high temperature bake oven particularly, but not exclusively, useful for baking pizza to temperatures ranging from 600 to 900° F. which may be used for baking pizza on a conventional gas, wood or briquette outdoor grill.

BACKGROUND OF THE INVENTION

The history of pizza began hundreds of years ago with the addition of toppings on flat bread, such as the Greek "Pita," "Pide" in Turkey, "Naan" or "Paratha" in India and "Flammkuchen" in Germany. The first reference to "Pizza" is by the Italian Renaissance Chef Scappi published in 1570. However, the now preferred Neapolitan-style pizza requires baking at a temperature of between about 600 and 1000° F. The majority of pizza ovens are commercial brick ovens which are very large, expensive and require preheating generally for several hours. There are also dome-shaped pizza ovens which may be gas or coal fired which are also large and expensive. Finally, there are now commercial electric pizza ovens which typically do not heat the pizza to greater than 500° F. However, there are now also consumer pizza ovens which typically do not heat the pizza to greater than 450° F. and are also relatively expensive. At present, however, there are no relatively inexpensive consumer pizza ovens which heat the pizza to 600° F. or greater and which may be utilized as an insert for a conventional backyard-type grill. Typical commercial pizza ovens cost of tens of thousands of dollars.

SUMMARY OF THE INVENTION

The high temperature bake oven of this invention may be utilized to bake authentic hearth baked Neapolitan-style pizza at temperatures ranging from 600 to 900° F. and is thus comparable to a large, expensive brick pizza oven. However, the high temperature bake oven of this invention may also be used, for example, to bake flat bread including, for example, Greek "Pita," Turkish "Pide" flat bread or Indian "Naan" bread. The high temperature bake oven of this invention may also be used as an insert for a conventional coal, wood or gas briquette fired backyard grill which heats the internal bake oven chamber to a temperature of between 600 and 1000° F. in a relatively short time and is relatively inexpensive, particularly compared to commercial pizza ovens. Although the high temperature bake oven of this invention may be utilized as an insert for a backyard-type grill, the high temperature bake oven of this invention may also be a stand alone bake oven having its own source of heat.

The high temperature bake oven of this invention includes a source of convection heat which may also be a source of radiant heat including, for example, a gas fired flame or burning wood, briquettes or coal. The high temperature bake oven of this invention further includes a first stone-like plate located above the source of heat for receiving an item to be baked, such as a pizza or flat bread. As used herein, the term "stone-like" includes "pizza stone" available from several commercial sources and available online, which typically is formed of a Mullite-based ceramic refractory material capable of withstanding temperatures in excess of 1000° F., such as "Cordierite" and "FibraMent" or other stone-like materials capable of withstanding the extreme heat of the high temperature bake oven of this invention. The high temperature bake oven of this invention further includes a second stone-like plate located above the first stone-like plate which, in the disclosed embodiment, is generally parallel to the first stone-like plate. The high temperature bake oven of this invention further includes a housing enclosing the second stone-like plate and defining a bake oven chamber between the first and second stone-like plates having a front opening directing convection heat upwardly from the source of heat against the second stone-like plate and between the first and second stone-like plates over an item to be baked on the first stone-like plate and through the front opening of the housing. The high temperature bake oven of this invention creates a draft and thus circulates heated air from the source of heat through the bake oven chamber having an item to be baked on the first stone-like plate and through the front opening, quickly raising the temperature in the bake oven chamber to 600 to 1000° F. suitable for baking true New York or Neapolitan-style pizza. The upper or second stone-like plate also radiates heat onto the item being baked on the first stone-like plate.

In the disclosed embodiment of the high temperature bake oven of this invention, the housing includes side walls and a rear wall, wherein the second stone-like plate is spaced from the rear wall of the housing, such that heated convection air is directed and circulated upwardly from the source of heat into the back of the housing and circulated through the bake oven chamber and out of the front opening, creating a continuous circulation of heated air, quickly raising the temperature of the bake oven chamber to the desired temperature. In the disclosed embodiment, the first and second stone-like plates are round and the housing is rectangular, such that although a majority of the heated air circulated from the back to the front opening, air is also circulated around the first stone-like plate. Further, in the disclosed embodiment, the first stone-like plate has a greater diameter and is thicker than the second stone-like plate. Alternatively, for example where the high temperature bake oven of this invention is used for a commercial pizza oven, the second stone-like plate may be as large or larger than the first stone-like plate and may serve as the cover. A smaller, thinner second stone-like plate has the advantage of faster heating, which may be important for domestic or home use.

Further, in the disclosed embodiment of the high temperature bake oven of this invention, the first stone-like plate which receives the item to be baked is rotatably supported in the bake oven chamber, such that the first stone-like plate may be rotated during baking within the oven chamber. In the disclosed embodiment, the first stone-like plate is rotatably supported on a hemispherical plate which is concave toward the source of convection heated air, such that the heated air is directed outwardly around the first stone-like plate. Further, the housing includes a baffle which is inclined upwardly from the back wall, directing heated air into the bake oven chamber between the first and second stone-like plates. The upper plate may be supported on flanges attached to the side walls of the housing and the rear deflector plate. In the disclosed embodiment, the housing includes a cover over the second stone-like plate which extends generally parallel to the second stone-like plate and holds heat within the bake oven chamber.

As will be understood by those skilled in this art, various modifications may be made to the high temperature bake oven of this invention within the purview of the appended claims and the following description of the preferred embodiments is intended for illustrative purposed only and thus do not limit the scope of the invention, except as set forth in the appended claims.

DESCRIPTION OF THE PREFERRED EMBODIMENTS

Figure 2:
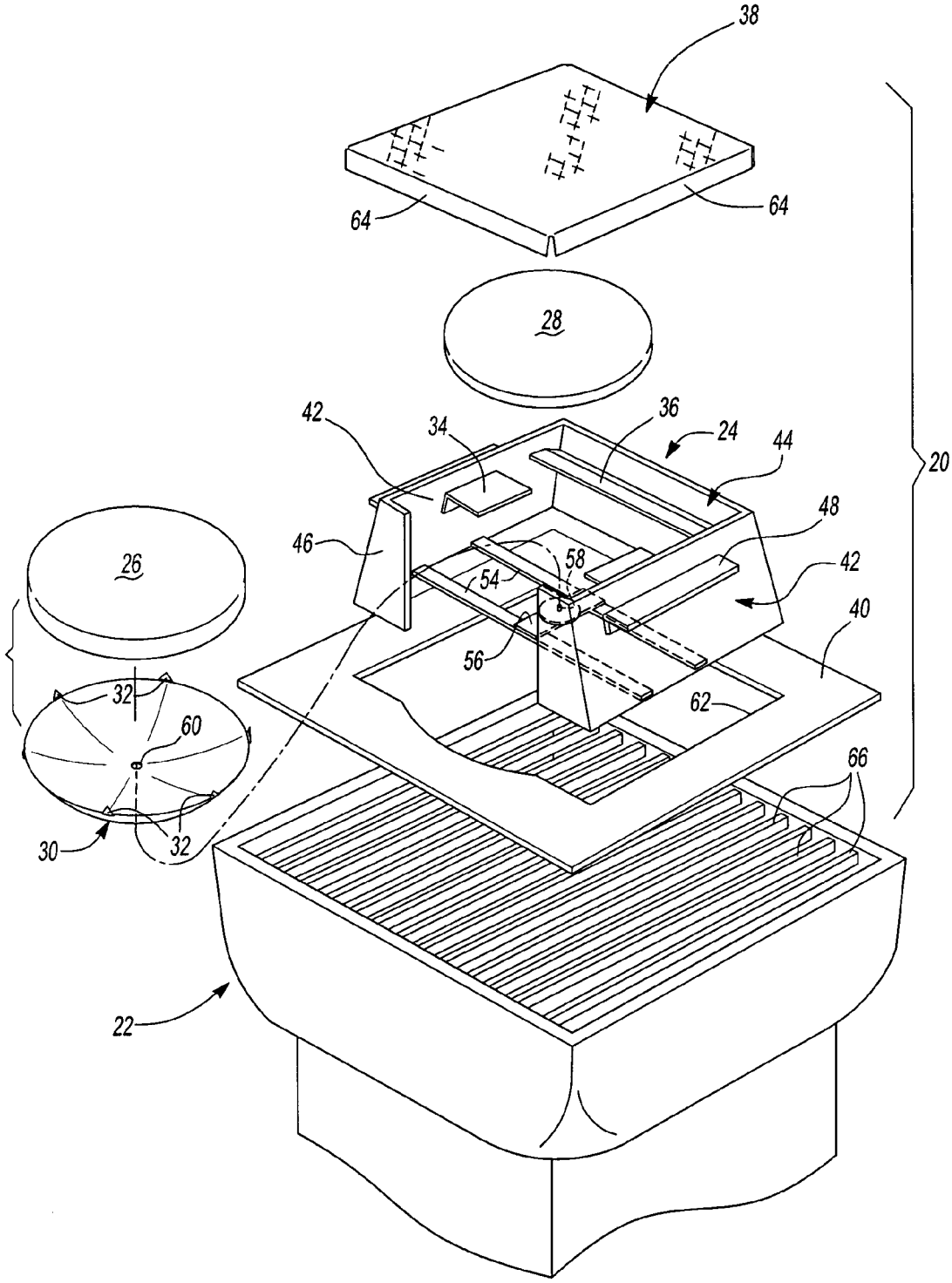
FIG. 2 is an exploded perspective view of the high temperature bake oven shown in FIG. 1.

As set forth above, the disclosed embodiment of the high temperature bake oven 20 of this invention may be utilized to bake flat bread, but is particularly useful for baking authentic hearth baked New York or Neapolitan-style pizza which requires a baking temperature of between about 600 and 1000° F. The high temperature bake oven 20 of this invention may be utilized with a conventional backyard-type grill, such as the grill shown at 22, or the high temperature bake oven of this invention may include its own source of convection heat (not shown) including, for example, a gas fired flame burning wood, coal or briquettes. The components of the disclosed embodiment of the high temperature bake oven 20 of this invention are best shown in FIG. 2, which in the disclosed embodiment include a housing or frame assembly 24, a first stone-like plate 26, a second stone-like plate 28 supported in spaced parallel relation above the first stone-like plate 26, a turntable 30 for the first stone-like plate 26 which, in the disclosed embodiment, is a hemispherical or bowl-shaped member which, in the disclosed embodiment, includes a plurality of circumferentially spaced upstanding tangs or tabs 32 which surround and retain the first stone-like plate 26. As will be understood by those skilled in the art, the temperature of the bake oven chamber between the first and second stone-like plates 26 and 28 will be greater near the back and thus it will be advantageous to rotate the first stone-like plate 26 during baking to prevent burning of the item on the first stone-like plate. The second stone-like plate 28 is supported on a deflector 36 and flanges 34 attached to the side walls of the housing 24. The disclosed embodiment of the high temperature bake oven of this invention further includes a cover 38 enclosing the top of the housing 24 and forming a bake oven chamber, and a baffle 40 directing heated air from the grill 22 into the high temperature bake oven 20 as described below.

Figure 1:
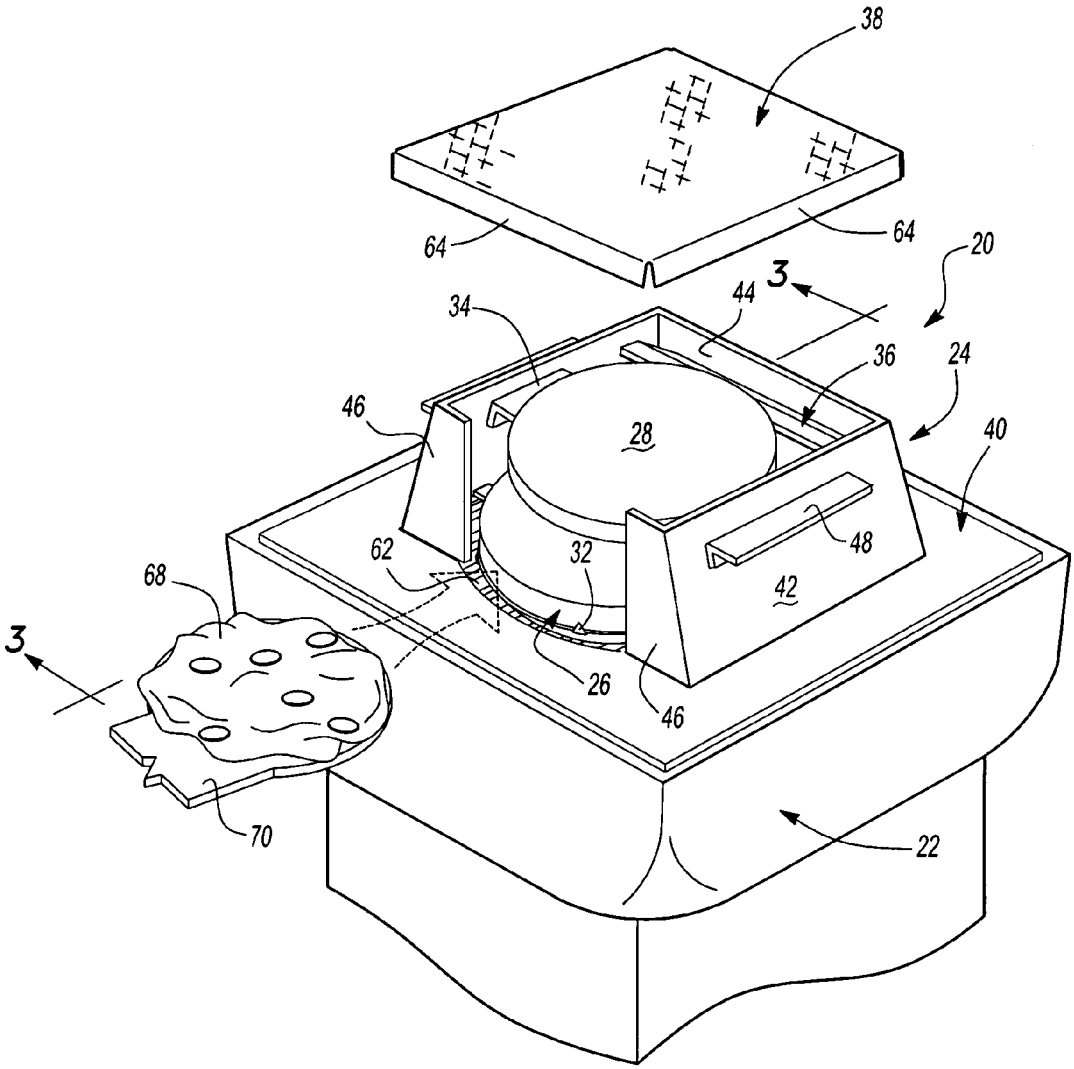
FIG. 1 is a perspective view of one embodiment of the high temperature bake oven of this invention with the cover raised.
Figure 3:
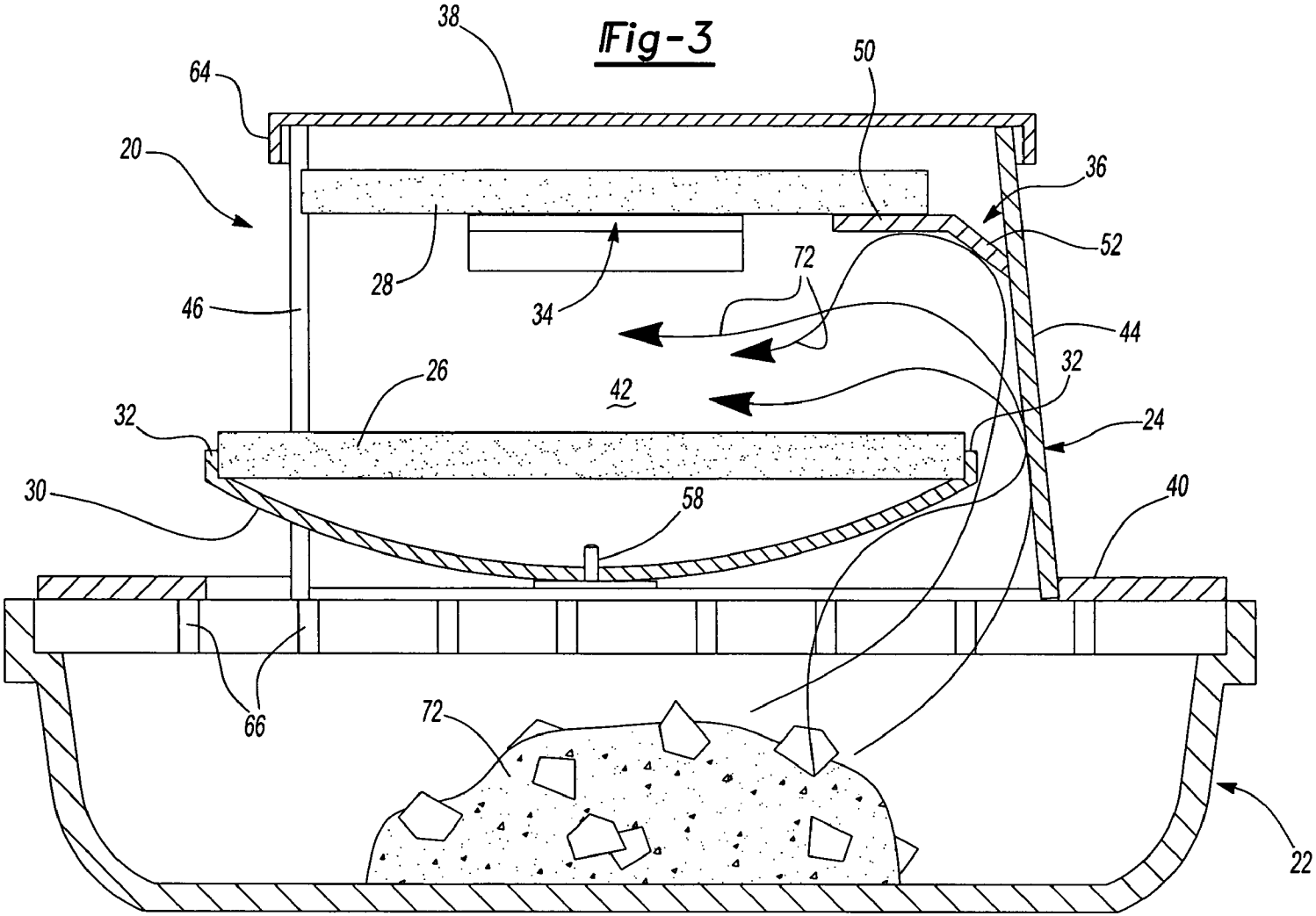
FIG. 3 is a side cross-sectional view of the high temperature bake oven shown in FIGS. 1 and 2.

The housing 24 includes side housing members 42, which are inclined inwardly to direct heated air to the upper or second stone-like plate 28, a back or rear housing member 44, which is also inclined upwardly as shown in FIG. 3 to direct heated air inwardly toward the second stone-like plate 26, and front side members 46 which are generally triangular in shape, but truncated as shown in FIG. 2. Thus, the housing 24, including the cover 38, encloses the first and second stone-like plates 26 and 28 forming a bake oven chamber between the first and second stone-like plates 26 and 28, respectively, with a front opening between the front side members 46, creating a high temperature draft through the bake oven chamber and heating an item on the first stone-like plate 26 to very high temperatures, as described herein. As shown in FIGS. 1 and 3, the front opening of the housing 24 between the front side members 46 has a height generally equal to the distance between the first and second stone-like plates 26 and 28 and is aligned with the space between the first and second stone-like plates 26 and 28.

In the disclosed embodiment, the side housing members 42 includes optional handles 48 for lifting the high temperature bake oven 20 off of the grill 22. The deflector 36 includes a horizontal portion 50, which supports the second stone-like plate 28 as shown in FIG. 3, and a deflector portion 52 which is angled upwardly from the back housing member 44 as also shown in FIG. 3. As shown in FIG. 2, the housing 24 includes lower parallel cross members 54, and a central transverse member 56 which support a pivot rod assembly 58. The pivot rod 58 is received in a hole 60 in the bowl-shaped turntable 30 as shown in FIGS. 2 and 3, permitting the first stone-like plate 26 to be easily rotated as described below. As will be understood, the temperature The baffle 40 covers the grill opening and the baffle includes an opening 62 configured to receive the housing 24 and the lower or first stone-like plate 26 as further disclosed below. In the disclosed embodiment, the cover 38 includes flanges 64 which receive the walls of the housing 24 as shown. Further, in the disclosed embodiment, the grill 22 includes transverse grates 66 which support the high temperature bake oven 20.

Figure 4:
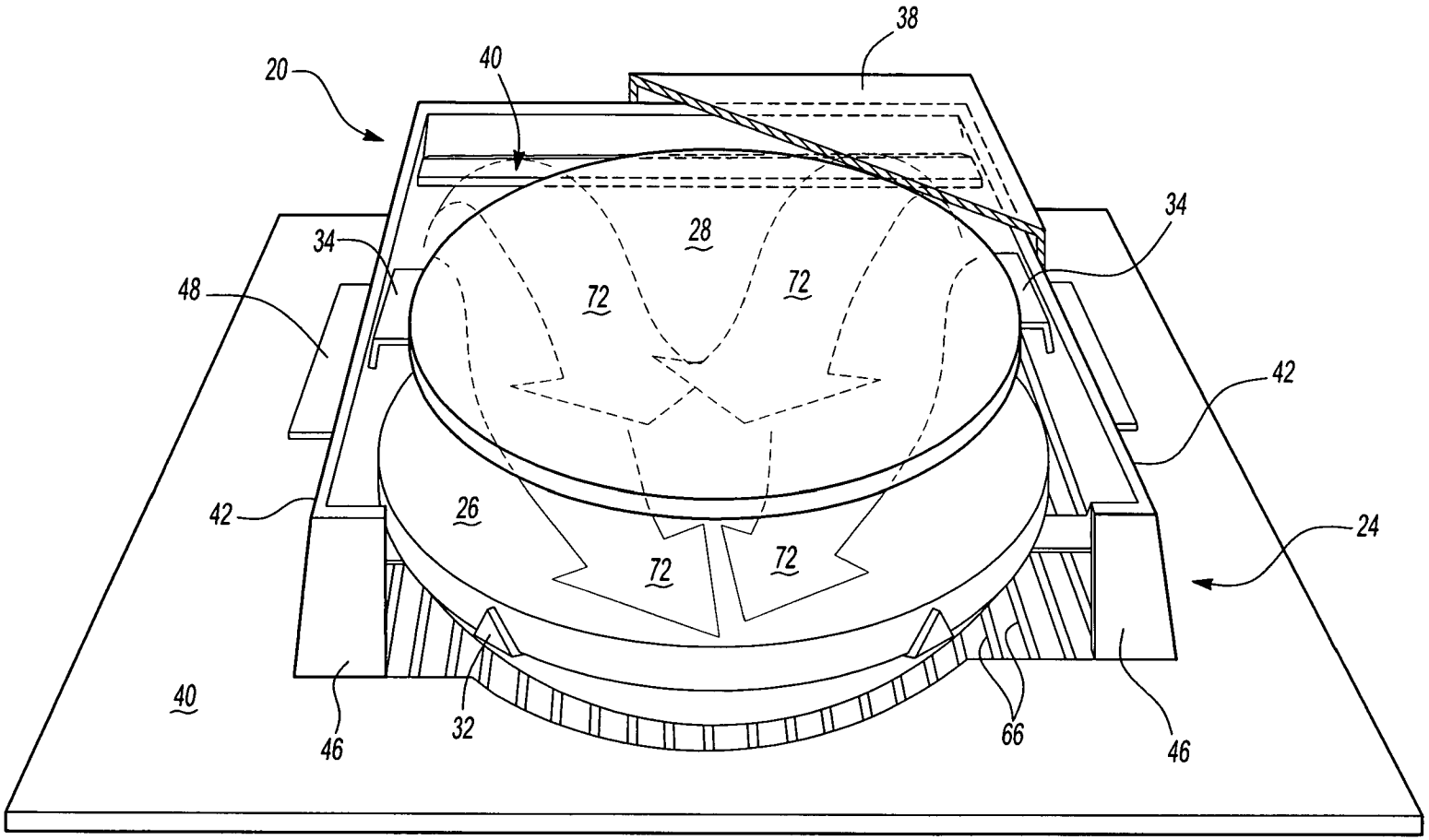
FIG. 4 is a partial front perspective view of the high temperature bake oven shown in FIGS. 1 to 3 with the cover partially removed and cross-sectioned.

As shown in FIG. 1, the item to be baked, such as the pizza 68, is received through the front opening of the high temperature bake oven 20 between the front side members 46 of the oven. In the disclosed embodiment, the pizza 68 is received on a slide 70 and disposed through the front opening onto the first stone-like plate 26. FIG. 1 also illustrates the relative orientation of the first and second stone-like plates 26 and 28 upon receipt of the item to be baked, such as the pizza 68, wherein the first and second stone-like plates 26 and 28 are in parallel relation and relatively closely spaced. FIGS. 3 and 4 illustrate the draft circulation of heated air through the bake oven chamber formed by the housing 24 including the cover 38. As best shown in FIG. 3, the grill includes a source of heat, such as a burning charcoal 72. The heated air rises by convection and because the lower or first stone-like plate 26 is spaced from the back housing member 44, the heated air is primarily directed upwardly between the back housing member 44 and the first stone-like plate 26 as shown by arrows 72. As will be understood, however, because the first stone-like plate 26 is circular and the housing 24 is rectangular, heated air will also be drawn upwardly around the first stone-like plate 24. The draft of hot air as shown by arrows 72 in FIGS. 3 and 4, heats the first and second stone-like plates 24 and 26, respectively, by convection. However, the heated first and second stone-like plates then radiate heat to an item to be baked on the first stone-like plate 24, such as the pizza 68 shown in FIG. 1. Thus, the design of the housing 24 promotes the rapid draft circulation of heated air as shown by arrows 72. Further, the hemispherical or bowl-shaped turntable 30 directs the circulation of heat outwardly, further promoting the draft circulation of the heated air. The circulation of the heated air is also promoted by the inwardly inclined side and back walls 42 and 44, respectively, and the baffle portion 52 of the baffle 36 as shown in FIG. 3. In the disclosed embodiment, the first stone-like plate 26 has a diameter greater than the diameter of the second or upper stone-like plate 28 and the first stone-like plate 26 is set forwardly as shown in FIG. 3, promoting the draft circulation of heated air into the bake oven chamber from between the first stone-like plate 26 and the rear housing member 44.

As set forth above, the first and second stone-like plates 24 and 26 may be formed of any "stone-like" material including for example Mullite-based refractory ceramic materials, including "pizza stone" available from several sources on line, including "Cordierite" and "FibraMent." The baffle 40 and housing 24 may be formed of steel and the L-shaped side flanges 34 and deflector 36 may be welded to the side and back housing members 42 and 44, respectively. Similarly, the parallel cross members 54 may be welded to the side housing members 42. In the disclosed embodiment, the tangs or tabs 32 are triangular and may be engaged by any tool to rotate the lower first stone-like plate 26, such that the item on the first stone-like plate 26 is evenly heated. Alternatively, as set forth below, the turntable may be powered. In the disclosed embodiment, the first and second stone-like plates 24 and 26 are parallel and may be spaced two to three inches apart. However, depending upon the diameter of the stone-like plates, the stone-like plates could be spaced further apart. The bottom or first stone-like plate may be positioned approximately one to two inches above the grill surface. The first stone-like plate may have a diameter of approximately 16 inches and the upper second stone-like plate may have a diameter of about 12 to 13 inches. The space between the back of the first stone-like plate 26 may be one to two inches from the back housing member 44 to promote a draft around the rearward portion of the first stone-like plate for better draft circulation as described above. The cover 38 may be formed of aluminum because of the high heat conductivity of aluminum which increases the efficiency of the overhead heating of the item to be baked. Alternatively, the second stone-like plate 28 may serve as the cover, in which case, the second stone-like plate 28 may be rectangular and larger than the first stone-like plate 26.

The high temperature bake oven of this invention may be utilized to bake pizza, for example, at temperatures ranging from 600 to 1000° F. making authentic hearth baked New York or Neapolitan-style pizza and may be utilized with any conventional grill, such as a conventional backyard grill. However, various modifications may be made to the high temperature bake oven of this invention within the purview of the appended claims. For example, the first and second stone-like plates may be square or rectangular. However, in the disclosed embodiment, the upper stone-like plate 28 is smaller than the first stone-like plate 26 and the first stone-like plate is spaced from the rear wall or rear housing member 44. Further, although the high temperature bake oven of this invention has the advantage that it may be utilized with a conventional outdoor grill, the heat source and the high temperature oven may be combined in a single unit. Finally, the turntable 30 may be connected to a motor, rotating the turntable as is known in the art. Other modifications may also be made within the purview of the appended claims.

The invention claimed is:

1. A high temperature bake oven, comprising:

a source of convection heat;

a first pizza stone plate located above said source of heat for receiving an item to be baked;

a second pizza stone plate located above said first pizza stone plate: and a housing enclosing said first and second pizza stone plates and a bake oven chamber between said first and second pizza stone plates having an open front end during baking creating a draft directing convection heated air upwardly from said source of heat against said first and second pizza stone plates and between said first and second pizza stone plates over an item to be baked on said first pizza stone plate and through said open front end of said housing and a baffle opposite said open front end of said bake oven chamber angled upwardly from adjacent a back wall of said bake oven chamber toward said second pizza stone plate directing heated convection air against said second pizza stone plate, heating said second pizza stone plate, said heated convection air then directed over an item on said first pizza stone plate and between said first and second pizza stone plates through said open front end.

2. The high temperature bake oven as defined in claim 1, wherein said housing is spaced from a rear portion of said first pizza stone plate above said source of convection heat, whereby heated convection air is directed upwardly into said bake oven chamber.

3. The high temperature bake oven as defined in claim 1, wherein said open front end of said housing has a height generally equal to a distance between said first and second pizza stone plates and is aligned with an opening between said first and second stone-like plates.

4. The high temperature bake oven as defined in claim 1, wherein said first pizza stone plate is rotatably supported within said bake oven chamber.

5. The high temperature bake oven as defined in claim 4, wherein said first pizza stone plate is rotatably supported on a hemispherical plate convex toward said source of heat directing heated air outwardly around said first stone-like plate.

6. The high temperature bake oven as defined in claim 5, wherein said hemispherical plate includes a plurality of circumferentially spaced vertical portions surrounding said first stone-like plate for manually rotating said first pizza stone plate.

7. The high temperature bake oven as defined in claim 1, wherein said housing is supported on a grate and said source of heat is a fire located below said grate heating said bake oven to a temperature of greater than 600° F.

8. The high temperature bake oven as defined in claim 7, wherein said grate is larger than said housing and said high temperature bake oven includes a baffle plate surrounding said housing directing heated convection air rising from said source of convection heat into said housing.

9. The high temperature bake oven as defined in claim 1, wherein said first pizza stone plate is round and said housing is rectangular directing heated convection air around said first pizza stone plate to said second stone-like plate.

10. The high temperature bake oven as defined in claim 9, wherein said second pizza stone plate is round having a diameter less than a diameter of said first pizza stone plate.

11. The high temperature bake oven as defined in claim 1, wherein said first and second pizza stone plates are parallel and spaced apart of distance of between about two and five inches.

12. The high temperature bake oven as defined in claim 1, wherein said housing includes an aluminum cover over said second pizza stone plate extending generally parallel to said second stone-like plate.

13. The high temperature bake oven as defined in claim 1, wherein said pizza stone plates are formed of a ceramic material.

14. A high temperature bake oven, comprising:

a source of heat directing heated air upwardly;

a first pizza stone plate located above said source of heat for receiving an item to be baked;

a second pizza stone plate located above said first stone-like plate in generally parallel relation; and a housing supporting said second stone-like plate having back and side walls enclosing a high temperature bake oven chamber having an open front end during baking and said first pizza stone plate spaced from said back wall of said housing, whereby heated air is circulated upwardly between said first pizza stone plate and said back wall of said housing into said high temperature oven chamber between said first and second pizza stone plates and through said open front end heating said bake oven chamber to a temperature of at least 600° F. wherein said back wall of said housing includes a baffle opposite said front end opening angled upwardly toward said second pizza stone plate directing heated convection air between said first and second pizza stone plates toward said front end opening.

15. The high temperature bake oven as defined in claim 14, wherein said housing is supported on a grate and said source of heat is a fire located beneath said grate.

16. The high temperature bake oven as defined in claim 14, wherein said first pizza stone plate is rotatably supported within said bake oven chamber.

17. The high temperature bake oven as defined in claim 16, wherein said first pizza stone plate is rotatably supported on a hemispherical plate convex toward said source of heat directing heated air outwardly around said first pizza stone plate.

18. The high temperature bake oven as defined in claim 14, wherein said first and second pizza stone plates are round and said housing is rectangular.

19. The high temperature bake oven as defined in claim 14, wherein said first and second pizza stone plates are formed of a ceramic material.

* * * * *